United States Patent [19]

Mortensen

[11] Patent Number: 4,579,342

[45] Date of Patent: Apr. 1, 1986

[54] GAME TABLE

[76] Inventor: Charles A. Mortensen, 14255 Mango Dr., Del Mar, Calif. 92014

[21] Appl. No.: 669,935

[22] Filed: Nov. 9, 1984

[51] Int. Cl.[4] ..... A63D 15/00

[52] U.S. Cl. ..... 273/9; 273/8

[58] Field of Search ..... 273/3 R, 5 A, 8, 9, 273/4 B, 4 C, 2

[56] References Cited

U.S. PATENT DOCUMENTS

| | | | |
|---|---|---|---|
| 383,005 | 5/1888 | O'Connor | 273/9 |
| 1,552,489 | 9/1925 | Klein | 273/5 A |
| 3,138,387 | 6/1964 | Michel et al. | 273/3 R |
| 4,056,266 | 11/1977 | Gramstrup | 273/9 |

*Primary Examiner*—Richard C. Pinkham
*Assistant Examiner*—T. Brown
*Attorney, Agent, or Firm*—Freilich, Hornbaker, Rosen & Fernandez

[57] ABSTRACT

A game table having a base with four corner holes, to form the corners of a rectangle. The base also has two side holes, in the center of each side of the rectangle. There are four corner pocket pieces with a pair of ends. Each corner piece has an opening which can be positioned above and aligned with one of the center holes. There are also two side pocket pieces with a pair of ends. Each side pocket piece has an opening which can be positioned above and aligned with one of the side holes. In addition, there are two end rails and the ends of each rail engage the ends of two corner pocket pieces. There are also four side rails and the ends of each side rail engage the end of a corner pocket piece and the end of a side pocket piece. There are two end bumpers, each being attached to two corner pocket pieces and an end rail. Four side bumpers are provided, and each is attached to a corner pocket piece, a side pocket piece, and a side rail.

6 Claims, 8 Drawing Figures

GAME TABLE

BACKGROUND OF THE INVENTION

This invention relates to a game table, and, more particularly, to a kit for making a game table.

Johnson U.S. Pat. No. 1,881,387, entitled "Pool and Billiard Court," which issued on Oct. 4, 1932, describes an outdoor court, or table, having pockets, for use in place of a pool and billiard table. His table is located at substantially ground level, and is large enough for players to walk on while playing. Johnson discloses mallets, instead of cues, for driving the balls. While outdoor games of this type have existed since 1930, or earlier, they have not been widely used, or successful, primarily because of the cost, and difficulty, in making, transporting, and assembling the parts.

SUMMARY OF THE INVENTION

My invention is a kit for a game table which comprises eighteen basic parts: twelve light-weight, relatively small, easily packaged plastic parts, namely, six pocket pieces and six rails, and six light-weight, relatively small, easily packaged bumpers. So the kit is easily made, is cheap, can be packaged in small boxes, for shipment, and is easily put together.

DESCRIPTION OF THE INVENTION

My invention is a game kit, capable of being assembled in the field on a base 1, having four corner holes 2, which form the corners of a rectangle, said rectangle having two sides and two ends. The base also has two side holes 3 in the center of each side of the rectangle. The preferred base is a concrete slab.

Figure 1:
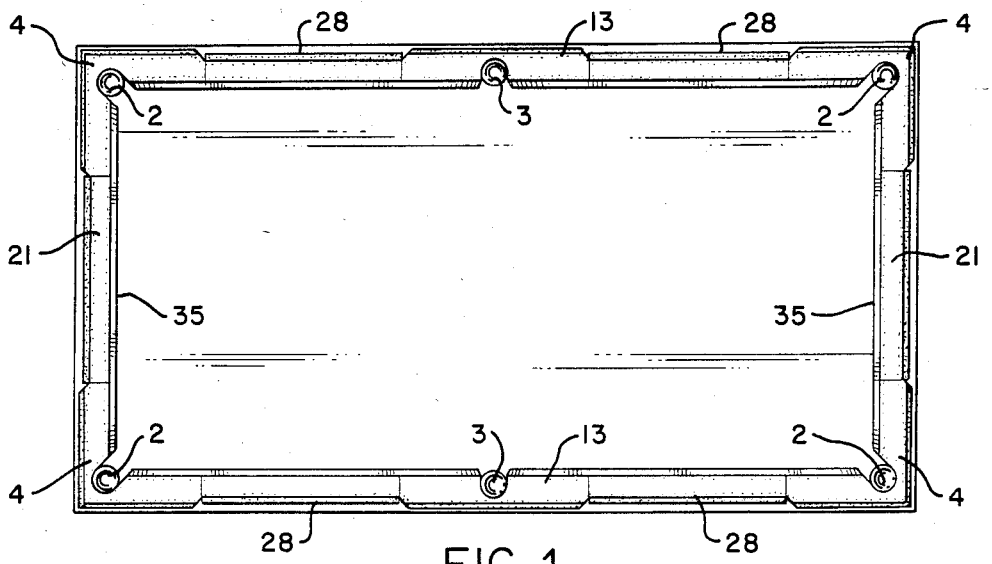
FIG. 1 is a plan view of the assembled game table.
Figure 2:
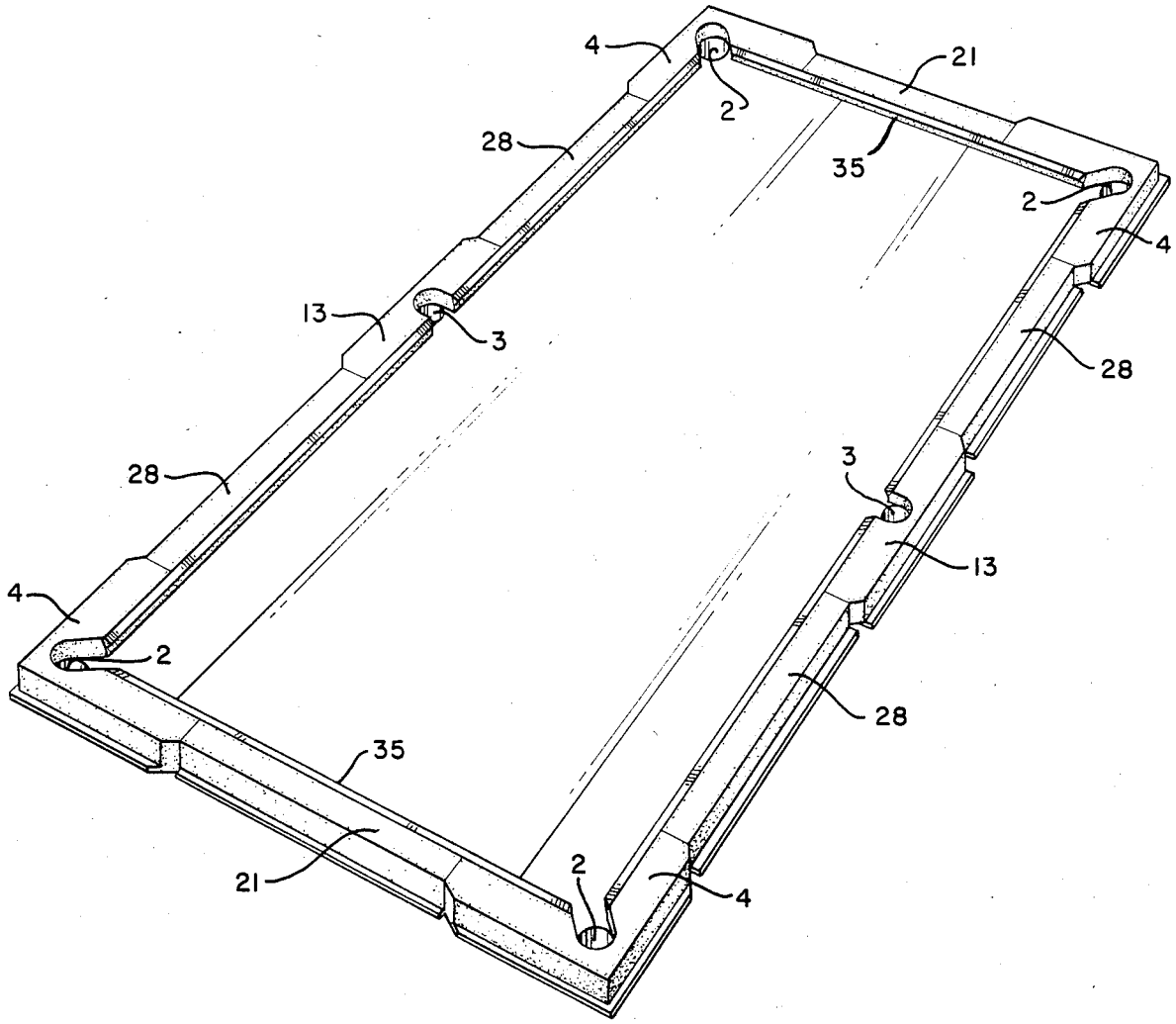
FIG. 2 is a perspective view of the assembled game table.
Figure 3:
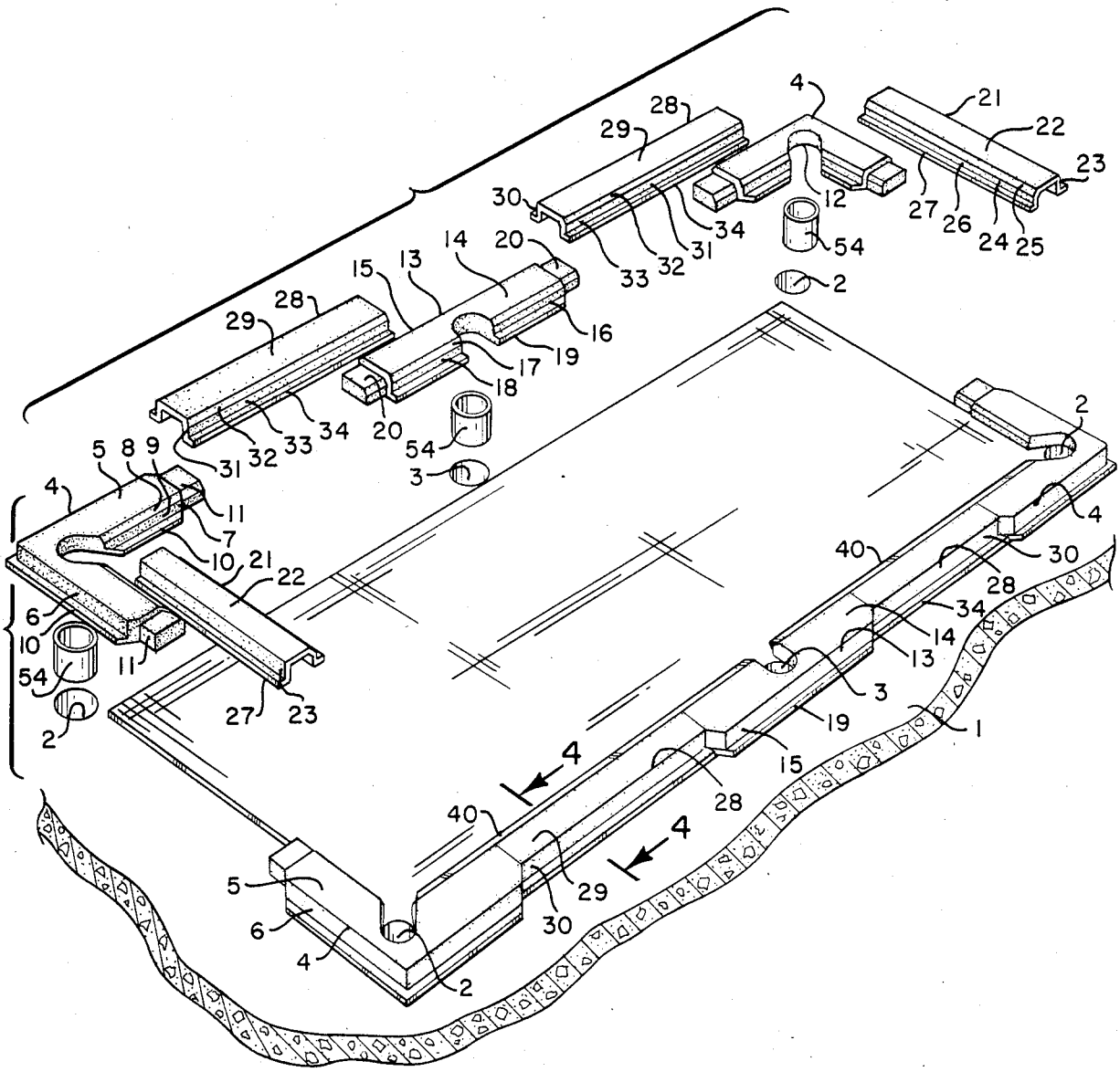
FIG. 3 is a partially exploded view of the game table.
Figure 4:
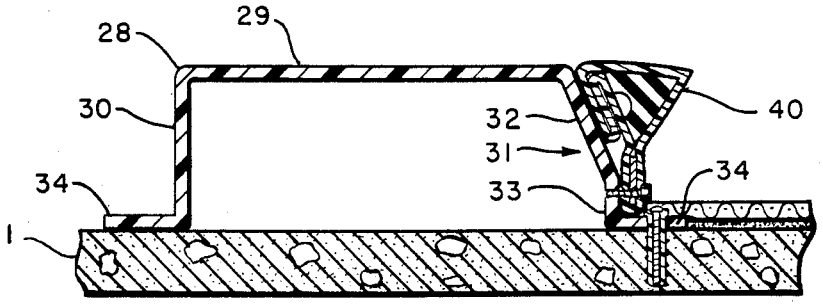
FIG. 4 is a cross-section of the game table along the line 4—4 in, FIG. 3.

The kit comprises these elements, best shown in FIGS. 1-4: four corner pocket pieces 4, each having two end sections, forming a right angle, each section including a top 5, and two downwardly extending sides 6, 7, the inner side 7 having an upper slanted face 8 and a lower face 9, said sides having outwardly extending horizontal flanges 10 at the bottom thereof, the end of each section having a reduced part 11, each corner pocket piece also having an opening 12 therein, near the right angle, and is adapted to be positioned above one of the corner holes, with the opening aligned therewith; two side pocket pieces 13, each having two aligned end sections, each section including a top 14 and two downwardly extending sides 15, 16, the inner side 16 having an upper slanted face 17 and a lower face 18, said sides having outwardly extending horizontal flanges 19 at the bottom thereof, the end of each section having a reduced part 20, each side pocket piece also having an opening therein, and is adapted to be positioned above one of the side holes, with the opening aligned therewith; two end rails 21, each including a top 22 and two downwardly extending sides 23, 24, the inner side 24 having an upper slanted face 25 and a lower face 26, said sides having outwardly extending horizontal flanges 27 at the bottom thereof, the ends of each rail being adapted to fit over the ends of two corner pocket pieces; and four side rails 28, best shown in FIG. 4, each including a top 29 and two downwardly extending sides 30, 31, the inner side 31 having an upper slanted face 32 and a lower face 33, said sides having outwardly extending horizontal flanges 34 at the bottom thereof, the ends of each rail being adapted to fit over the end of a corner pocket piece and the end of a side pocket piece. I prefer a tough plastic-like material, resistant to ordinary wear and tear, for the pocket pieces, and rails.

Figure 5:
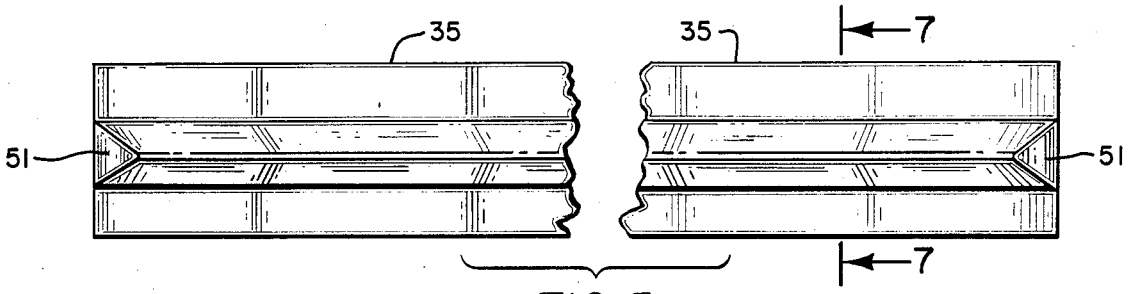
FIG. 5 is a top view of an end bumper.
Figure 6:
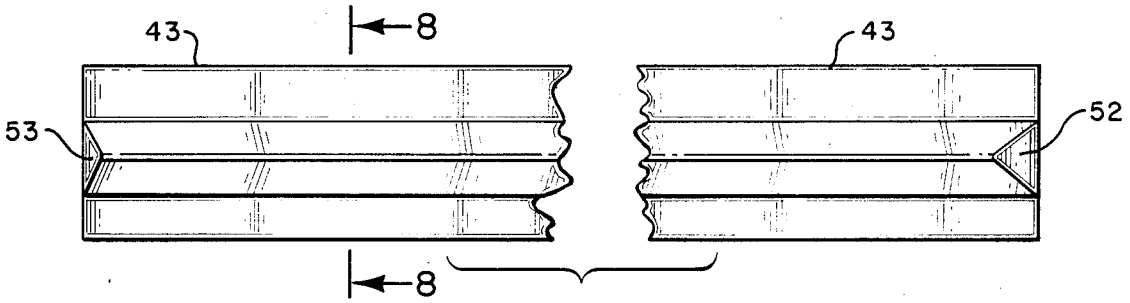
FIG. 6 is a top view of a side bumper.
Figure 7:
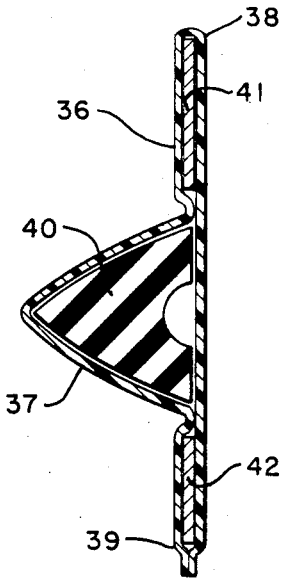
FIG. 7 is a cross-sectional view of the end bumper taken along the line 7—7 of FIG. 5.
Figure 8:
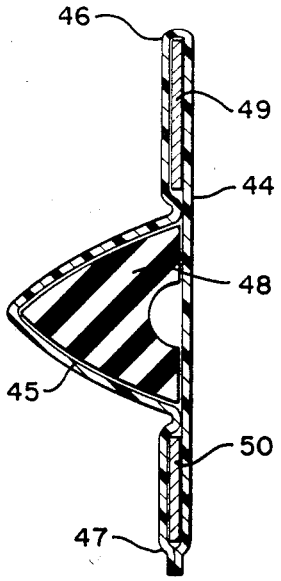
FIG. 8 is a cross-sectional view of the side bumper taken along the line 8—8 of FIG. 6.

The kit also comprises these elements, best shown in FIGS. 4-8: two end bumpers 35, shown in FIGS. 5 and 7, each including an elongated flexible covering 36 having an elongated middle, and two elongated side, pockets 37, 38, 39 therein, an elongated resilient member 40 in the middle pocket, a first elongated batten 41 in one of the side pockets, and a second elongated batten 42 in the other side pocket, the first batten being adapted to be attached to the upper slanted faces of two corner pocket pieces and an end rail, and the second batten being adapted to be attached to the lower faces of two corner pocket pieces and an end rail; and four side bumpers 43, shown in FIGS. 6 and 8, each including an elongated flexible covering 44 having an elongated middle, and two elongated side, pockets 45, 46, 47 therein, an elongated resilient member 48 in the middle pocket, a first elongated batten 49 in one of the side pockets, and a second elongated batten 50 in the other side pocket, the first batten being adapted to be attached to the upper slanted faces of a corner pocket piece, a side pocket piece, and a side rail, and the second batten being adapted to be attached to the lower faces of a corner pocket piece, a side pocket piece, and a side rail. I prefer vinyl for the flexible coverings, because it is weather resistant, and I prefer to form the pockets by sewing opposite sides of the vinyl together. Also, I prefer a triangular shaped cross-section for the resilient members, as shown in FIG. 4. I cut each end 51 of the end bumpers at 45°, as shown in FIG. 5. I also cut one end 52 of the side bumpers at 45°, and the other end 53 at 15%, as shown in FIG. 6.

The kit may also comprise these elements: six cups 54 to be placed in the holes in the base, a plurality of balls (not shown), a plurality of mallets, or cues (not shown), and a floor covering for the base (not shown).

In installing the kit, I first position the pocket pieces on the concrete base, with the openings positioned above the holes. Next, I drill through the horizontal flanges and the concrete with a Hilti rotary hammer. Then, I drive Hilti fasteners into the holes to fasten the pocket pieces to the concrete base. After that, I position the rails on the concrete base, with the ends fitted over the ends of the pocket pieces, and drill through the horizontal flanges and concrete. Finally, I drive Hilti fasteners into the holes to fasten the rails to the concrete base.

I then fasten the bumpers to the faces of the pocket pieces and rails. As an illustration, I fasten an end bumper to an end rail and corner pocket pieces in these steps: First, I place the lower batten against the upper slanted faces of the end rail and corner pocket pieces, with the resilient member facing outward. Second, I fasten the lower batten to the upper slanted faces with self tapping metal screws. Third, I fold the bumper downward, so the resilient member faces inward and the other batten is against the lower faces of the end rail and pocket pieces, as shown in FIG. 4. Fourth, I fasten the other batten to the lower faces with self tapping metal screws. These steps are repeated with the other end bumper, and the four side bumpers. For good playability, the 15% cut on the side bumpers should be next to the side pockets. Lastly, the base is covered with a floor covering, such as astroturf.

Although I have described the best mode contemplated by me for carrying out my invention, modifications and variations will undoubtedly readily occur to those skilled in the art after reading my description. So I intend that the claims be interpreted to cover such modifications and variations under the doctrine of equivalents.

I claim:

1. A game kit, capable of being assembled in the field, on a base having four corner holes, to form the corners of a rectangle, said rectangle having two sides and two ends, the base also having two side holes, in the center of each side of the rectangle, said kit comprising:

four corner pocket pieces, each having two end sections, forming a right angle, each section including a top, and two downwardly extending sides, the inner side having an upper slanted face and a lower face, said sides having outwardly extending horizontal flanges at the bottom thereof, the end of each section having a reduced part, each corner pocket piece also having an opening therein, near the right angle, and adapted to be positioned above one of the corner holes, with the opening aligned therewith;

two side pocket pieces, each having two aligned end sections, each section including a top and two downwardly extending sides, the inner side having an upper slanted face and a lower face, said sides having outwardly extending horizontal flanges at the bottom thereof, the end of each section having a reduced part, each side pocket piece also having an opening therein, and adapted to be positioned above one of the side holes, with the opening aligned therewith;

two end rails, each including a top and two downwardly extending sides, the inner side having an upper slanted face and a lower face, said sides having outwardly extending horizontal flanges at the bottom thereof, the ends of each rail being adapted to fit over the ends of the corner pocket pieces;

four side rails, each including a top and two downwardly extending sides, the inner side having an upper slanted face and a lower face, said sides having outwardly extending horizontal flanges at the bottom thereof, the ends of each rail being adapted to fit over the end of a corner pocket piece and the end of a side pocket piece;

two end bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being adapted to be attached to the upper slanted faces of two corner pocket pieces and an end rail, and the second batten being adapted to be attached to the lower faces of two corner pocket pieces and an end rail;

four side bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being adapted to be attached to the upper slanted faces of the inner sides of a corner pocket piece, a side pocket piece, and a side rail, and the second batten being adapted to be attached to the lower faces of a corner pocket piece, a side pocket piece, and a side rail;

six cups adapted to fit in the holes in the base; and a covering for the base.

2. A game kit, capable of being assembled in the field, on a base having four corner holes, to form the corners of a rectangle, said rectangle having two sides and two ends, the base also having two side holes therein, in the center of each side of the rectangle, said kit comprising:

four corner pocket pieces, each having two end sections, forming a right angle, each section including a top, and two downwardly extending sides, the inner side having an upper slanted face and a lower face, said sides having outwardly extending horizontal flanges at the bottom thereof, the end of each section having a reduced part, each corner pocket piece also having an opening therein, near the right angle, and adapted to be positioned above one of the corner holes, with the opening aligned therewith;

two side pocket pieces, each having two aligned end sections, each section including a top and two downwardly extending sides, the inner side having an upper slanted face and a lower face, said sides having outwardly extending horizontal flanges at the bottom thereof, the end of each section having a reduced part, each side pocket piece also having an opening therein, and adapted to be positioned above one of the side holes, with the opening aligned therewith;

two end rails, each including a top and two downwardly extending sides, the inner side having an upper slanted face and a lower face, said sides having outwardly extending horizontal flanges at the bottom thereof, the ends of each rail being adapted to fit over the ends of the corner pocket pieces;

four side rails, each including a top and two downwardly extending sides, the inner side having an upper slanted face and a lower face, said sides having outwardly extending horizontal flanges at the bottom thereof, the ends of each rail being adapted to fit over the end of a corner pocket piece and the end of a side pocket piece;

two end bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being adapted to be attached to the upper slanted faces of two corner pocket pieces and an end rail, and the second batten being adapted to be attached to the lower faces of two corner pocket pieces and an end rail; and four side bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being adapted to be attached to the upper slanted faces of the inner sides of a corner pocket piece, a side pocket piece, and a side rail, and the second batten being adapted to be attached to the lower faces of a corner pocket piece, a side pocket piece, and a side rail.

3. A game kit, capable of being assembled in the field, on a base having four corner holes, to form the corners of a rectangle, said rectangle having two sides and two ends, the base also having two side holes, in the center of each side of the rectangle, said kit comprising;

four corner pocket pieces, each having two end sections, forming a right angle, each section including a top, and two downwardly extending sides, the inner side having an upper slanted face and a lower face, said sides having outwardly extending horizontal flanges at the bottom thereof, the end of each section having a reduced part, each corner pocket piece also having an opening therein, near the right angle, and adapted to be positioned above one of the corner holes, with the opening aligned therewith;

two side pocket pieces, each having two aligned end sections, each section including a top and two downwardly extending sides, the inner side having an upper slanted face and a lower face, said sides having outwardly extending horizontal flanges at the bottom thereof, the end of each section having a reduced part, each side pocket piece also having an opening therein, and adapted to be positioned above one of the side holes, with the opening aligned therewith;

two end rails, each including a top and two downwardly extending sides, the inner side having an upper slanted face and a lower face, said sides having outwardly extending horizontal flanges at the bottom thereof, the ends of each rail being adapted to fit over the ends of the corner pocket pieces;

four side rails, each including a top and two downwardly extending sides, the inner side having an upper slanted face and a lower face, said sides having otwardly extending horizontal flanges at the bottom thereof, the ends of each rail being adapted to fit over the end of a corner pocket piece and the end of a side pocket piece;

two end bumpers, each including an elongated resilient, member with a pair of elongated sides, a first elongated batten hinged to one side, and a second elongated batten hinged to the other side, the first batten being adapted to be attached to the upper slanted faces of two corner pocket pieces and an end rail, and the second batten being adapted to be attached to the lower faces of two corner pocket pieces and an end rail; and four side bumpers, each including an elongated resilient member with a pair of elongated sides, a first elongated batten hinged to one side, and a second elongated batten hinged to the other side, the first batten being adapted to be attached to the upper slanted faces of a corner pocket piece, a side pocket piece, and a side rail, and the second batten being adapted to be attached to the lower face of a corner pocket piece, a side pocket piece, and a side rail.

4. A game table, comprising:

a base having four corner holes, to form the corners of a rectangle, said rectangle having two sides and two ends, the base also having two side holes, in the center of each side of the rectangle;

four corner pocket pieces, each having two end sections, forming a right angle, each section including a top, and two downwardly extending sides, the inner side having an upper slanted face and a lower face, said sides having outwardly extending horizontal flanges at the bottom thereof, the end of each section having a reduced part, each corner pocket piece also having an opening therein, near the right angle, each corner pocket piece being positioned above one of the corner holes, with the opening aligned therewith;

two side pocket pieces, each having two aligned end sections, each section including a top and two downwardly extending sides, the inner side having an upper slanted face and a lower face, said sides having outwardly extending horizontal flanges at the bottom thereof, the end of each section having a reduced part, each side pocket piece also having an opening therein, each side pocket piece being positioned above one of the side holes, with the opening aligned therewith;

two end rails, each including a top and two downwardly extending sides, the inner side having an upper slanted face and a lower face, said sides having outwardly extending horizontal flanges at the bottom thereof, the ends of each rail being fitted over the ends of two corner pocket pieces;

four side rails, each including a top and two downwardly extending sides, the inner side having an upper slanted face and a lower face, said sides having outwardly extending horizontal flanges at the bottom thereof, the ends of each rail being fitted over the end of a section of a corner pocket piece and the end of a section of a side pocket piece;

two end bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being attached to the upper slanted faces of two corner pocket pieces and an end rail, and the second batten being attached to the lower faces of two corner pocket pieces and an end rail;

four side bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being attached to the upper slanted faces of a corner pocket piece, a side pocket piece, and a side rail, and the second batten being attached to the lower faces of a corner pocket piece, a side pocket piece, and a side rail;

six cups in the holes in the base; and a covering on the base.

5. A game table, comprising:

a base having four corner holes, to form the corners of a rectangle, said rectangle having two sides and two ends, the base also having two side holes, in the center of each side of the rectangle;

four corner pocket pieces, each having two end sections, forming a right angle, each section including a top, and two downwardly extending sides, the inner side having an upper slanted face and a lower face, said sides having outwardly extending horizontal flanges at the bottom thereof, the end of each section having a reduced part, each corner pocket piece also having an opening therein, near the right angle, each corner pocket piece being positioned above one of the corner holes, with the opening aligned therewith;

two side pocket pieces, each having two aligned end sections, each section including a top and two downwardly extending sides, the inner side having an upper slanted face and a lower face, said sides having outwardly extending horizontal flanges at the bottom thereof, the end of each section having a reduced part, each side pocket piece also having an opening therein, each side pocket piece being positioned above one of the side holes, with the opening aligned therewith;

two end rails, each including a top and two downwardly extending sides, the inner side having an upper slanted face and a lower face, said sides having outwardly extending horizontal flanges at the bottom thereof, the ends of each rail being fitted over the ends of two corner pocket pieces;

four side rails, each including a top and two downwardly extending sides, the inner side having an upper slanted face and a lower face, said sides having outwardly extending horizontal flanges at the bottom thereof, the ends of each rail being fitted over the end of a section of a corner pocket piece and the end of a section of a side pocket piece;

two end bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being attached to the upper slanted faces of two corner pocket pieces and an end rail, and the second batten being attached to the lower faces of two corner pocket pieces and an end rail; and four side bumpers, each including an elongated flexible covering having an elongated middle pocket, and two elongated side pockets therein, an elongated resilient member in the middle pocket, a first elongated batten in one of the side pockets, and a second elongated batten in the other side pocket, the first batten being attached to the upper slanted faces of a corner pocket piece, a side pocket piece, and a side rail, and the second batten being attached to the lower faces of a corner pocket piece, a side pocket piece, and a side rail.

6. A game table, comprising:

a base having four corner holes, to form the corners of a rectangle, said rectangle having two sides and two ends, the base also having two side holes, in the center of each side of the rectangle;

four corner pocket pieces, each having two end sections, forming a right angle, each section including a top, and two downwardly extending sides, the inner side having an upper slanted face and a lower face, said sides having outwardly extending horizontal flanges at the bottom thereof, the end of each section having a reduced part, each corner pocket piece also having an opening therein, near the right angle, each corner pocket piece being positioned above one of the corner holes, with the opening aligned therewith;

two side pocket pieces, each having two aligned end sections, each section including a top and two downwardly extending sides, the inner side having an upper slanted face and a lower face, said sides having outwardly extending horizontal flanges at the bottom thereof, the end of each section having a reduced part, each side pocket piece also having an opening therein, each side pocket piece being positioned above one of the side holes, with the opening aligned therewith;

two end rails, each including a top and two downwardly extending sides, the inner side having an upper slanted face and a lower face, said sides having outwardly extending horizontal flanges at the bottom thereof, the ends of each rail being fitted over the ends of two corner pocket pieces;

four side rails, each including a top and two downwardly extending sides, the inner side having an upper slanted face and a lower face, said sides having outwardly extending horizontal flanges at the bottom thereof, the ends of each rail being fitted over the end of a section of a corner pocket piece and the end of a section of a side pocket piece;

two end bumpers, each including an elongated resilient member with a pair of elongated sides, a first elongated batten hinged to one side, and a second elongated batten hinged to the other side, the first batten being attached to the upper slanted faces of two corner pocket pieces and an end rail, and the second batten being attached to the lower faces of two corner pocket pieces and an end rail; and four side bumpers, each including an elongated resilient member with a pair of elongated sides, a first elongated batten hinged to one side, and a second elongated batten hinged to the other side, the first batten being attached to the upper slanted faces of a corner pocket piece, a side pocket piece, and a side rail, and the second batten being attached to the lower face of a corner pocket piece, a side pocket piece, and a side rail.

* * * * *